US008182284B2

(12) United States Patent
Kuo

(10) Patent No.: US 8,182,284 B2
(45) Date of Patent: May 22, 2012

(54) ELECTRICAL CONNECTOR ASSEMBLY WITH IMPROVED FASTENING DEVICE

(75) Inventor: Peter Kuo, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/964,720

(22) Filed: Dec. 9, 2010

(65) Prior Publication Data

US 2011/0143557 A1 Jun. 16, 2011

(30) Foreign Application Priority Data

Dec. 10, 2009 (TW) ..... 98223120

(51) Int. Cl.
*H01R 13/73* (2006.01)

(52) U.S. Cl. ..... 439/545; 439/569

(58) Field of Classification Search ..... 439/545, 439/552–557, 562, 563, 569, 570, 571, 572
See application file for complete search history.

(56) References Cited

U.S. PATENT DOCUMENTS 4,909,748 A * 3/1990 Kozono et al. ..... 439/247
4,978,313 A * 12/1990 Kameyama et al. ..... 439/248
6,302,747 B1 * 10/2001 Bui et al. ..... 439/736
6,494,749 B1 * 12/2002 Chang ..... 439/701
6,695,641 B1 * 2/2004 Lee ..... 439/493
6,773,286 B1 * 8/2004 Wu ..... 439/247
6,824,426 B1 * 11/2004 Spink, Jr. ..... 439/579
6,830,483 B1 * 12/2004 Wu ..... 439/638
6,832,931 B1 * 12/2004 Wu ..... 439/499
6,890,200 B1 * 5/2005 Wu ..... 439/247
6,896,556 B1 * 5/2005 Wu ..... 439/638
7,435,129 B2 * 10/2008 Su et al. ..... 439/483
7,452,238 B1 * 11/2008 Wu ..... 439/579
7,553,191 B2 * 6/2009 Su et al. ..... 439/637
7,572,144 B1 * 8/2009 Wu ..... 439/545
7,575,472 B1 * 8/2009 Wu ..... 439/545
7,585,184 B2 * 9/2009 Su et al. ..... 439/579
7,607,930 B1 * 10/2009 Wu ..... 439/247
7,651,350 B1 * 1/2010 Wu ..... 439/153
7,794,273 B2 * 9/2010 Xu et al. ..... 439/555
7,803,009 B2 * 9/2010 Su et al. ..... 439/492
7,922,527 B2 * 4/2011 Xu et al. ..... 439/557
2005/0272303 A1 * 12/2005 Wu ..... 439/499
2006/0079119 A1 * 4/2006 Wu ..... 439/492
2006/0110972 A1 * 5/2006 Wu ..... 439/358
2007/0026715 A1 * 2/2007 Huang et al. ..... 439/260
2008/0188136 A1 * 8/2008 Su et al. ..... 439/660
2008/0214054 A1 * 9/2008 Su et al. ..... 439/637
2010/0009569 A1 * 1/2010 Su et al. ..... 439/552
2011/0053429 A1 * 3/2011 Leach ..... 439/668
2011/0130047 A1 * 6/2011 Wang et al. ..... 439/660
2011/0143557 A1 * 6/2011 Kuo ..... 439/55
2011/0143558 A1 * 6/2011 Kuo ..... 439/55
2011/0281457 A1 * 11/2011 Hsieh et al. ..... 439/374

* cited by examiner

*Primary Examiner* — Ross Gushi
(74) *Attorney, Agent, or Firm* — Wei Te Chung; Andrew C. Cheng; Ming Chieh Chang

(57) ABSTRACT

An electrical connector includes a housing including a mating portion defining a mating direction and located on the front portion thereof and a supporting portion rearward extending from the mating portion, a plurality of contacts receiving in the housing, a cover assembled on the housing, a plurality of cables electrically connected to the contacts. The housing further includes a pair of wing portions extending from an rear wall of the mating portion and defining substantially a Z-like configuration in a top view.

20 Claims, 5 Drawing Sheets

ELECTRICAL CONNECTOR ASSEMBLY WITH IMPROVED FASTENING DEVICE

BACKGROUND OF THE INVENTION

1. Field of the Invention

The present invention relates generally to an electrical connector assembly, and more particularly to an electrical connector assembly used in electric device and having improved fastening device.

2. Description of the Prior Art

Serial Advanced Technology Attachment (SATA) connectors are widely used in electric device such as notebooks. A SATA connector always comprises a housing, a plurality of contacts received in the housing, and a cover assembled on the rear portion of the housing. And the SATA connector is always assembled on a board through inserting a plurality of post formed on the SATA connector into a plurality of holes formed on the board or through a plurality of stretch patches and holes corresponding to the stretch patches. However, the fastening structure above is not firm enough to influence the performance of the electrical connector.

Hence, in this art, an improved electrical connector to overcome the above-mentioned disadvantages of the prior art should be provided.

BRIEF SUMMARY OF THE INVENTION

A primary object, therefore, of the present invention is to provide an electrical connector with an improved fastening device.

In order to implement the above object, the electrical connector comprises a housing comprising a mating portion defining a mating direction and located on the front portion thereof and a supporting portion rearward extending from the mating portion, a plurality of contacts receiving in the housing, a cover assembled on the housing, a plurality of cables electrically connected to the contacts. The housing further comprises a pair of wing portions extending from an rear wall of the mating portion and defining substantially a Z-like configuration in a top view.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
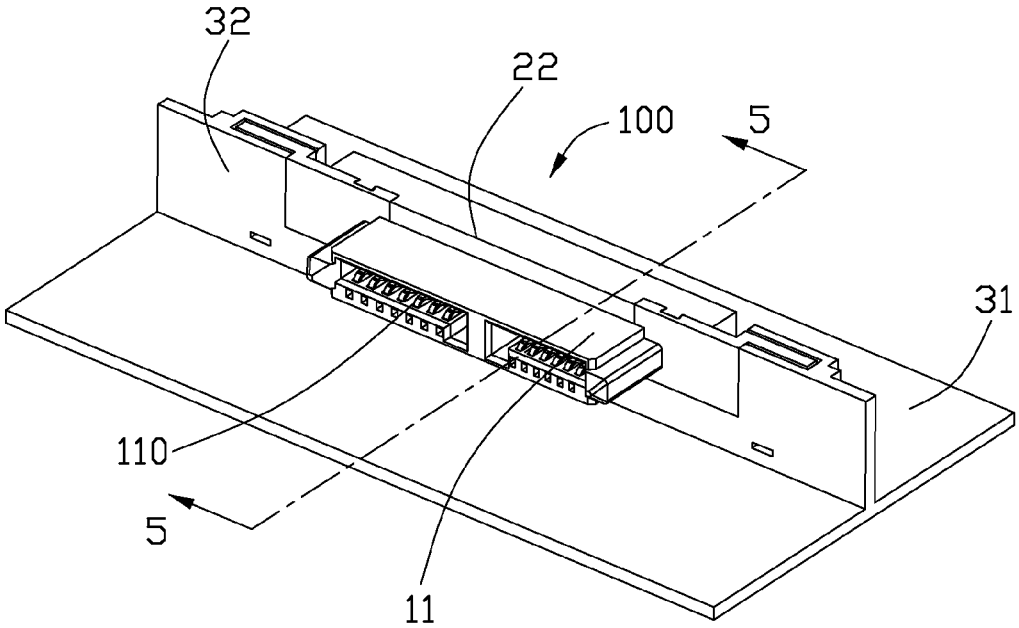
FIG. 1 is a perspective view of an electrical connector assembly in according with the present invention.
Figure 2:
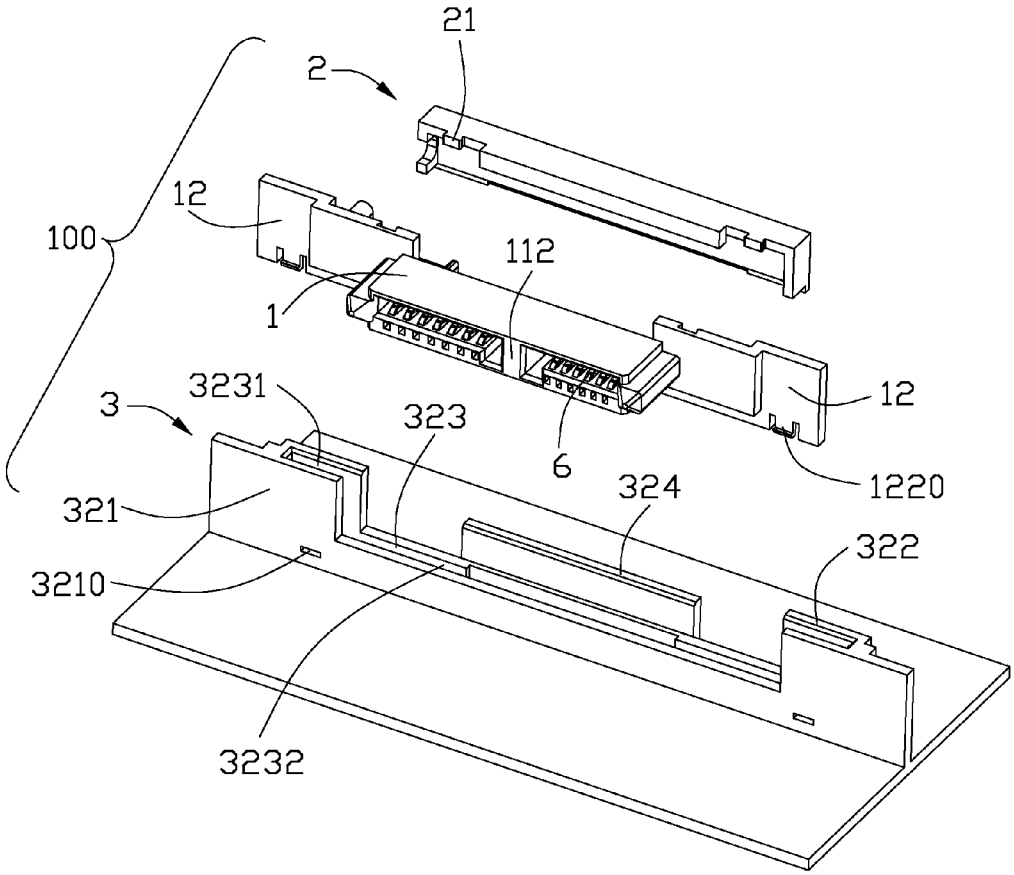
FIG. 2 is an exploded, perspective view of the electrical connector assembly in according with the present invention.
Figure 3:
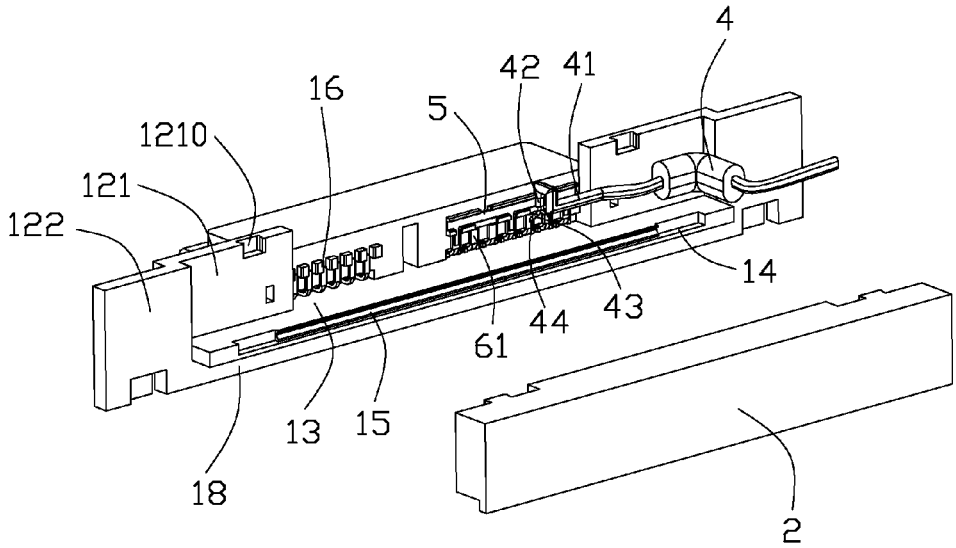
FIG. 3 is an assembled perspective view of part components of the electrical connector assembly of the present invention.
Figure 4:
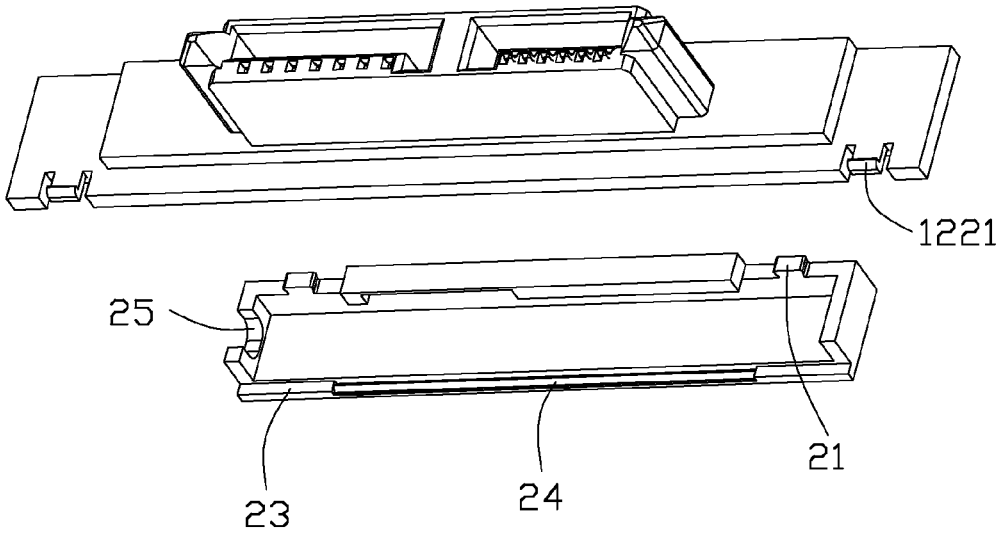
FIG. 4 is a view similar to FIG. 3, but taken from a different aspect.
Figure 5:
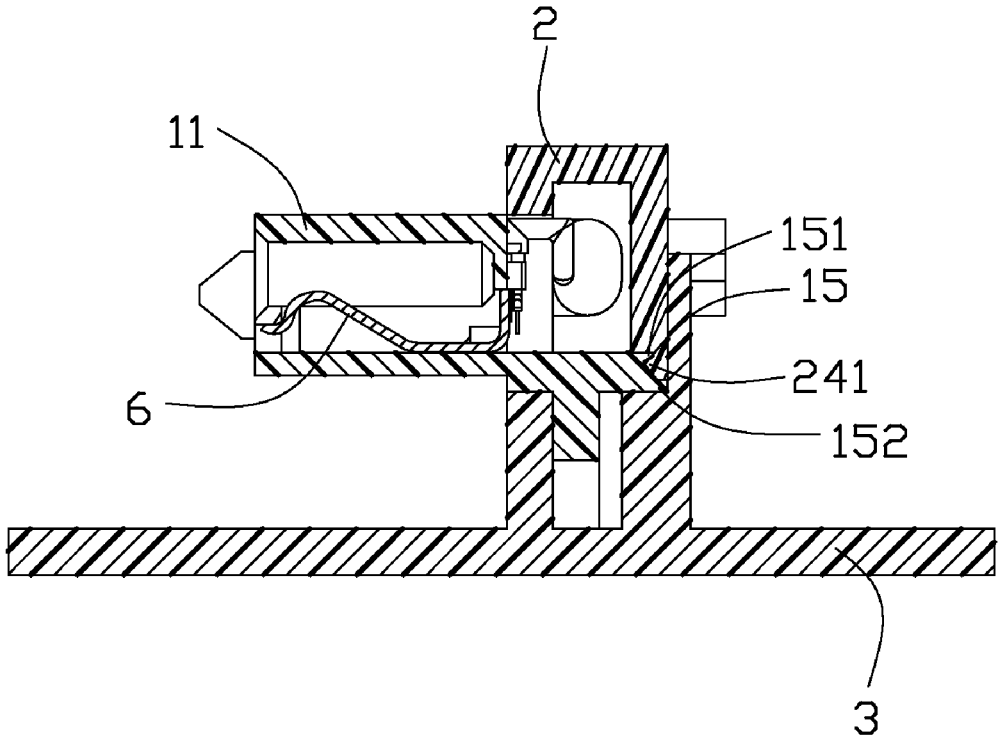
FIG. 5 is a cross-section view of the electrical connector assembly taken along line 5-5 of FIG. 1.

Reference to FIGS. 1 to 5, an electric connector assembly 100 in according with a preferred embodiment of the present invention is shown. The electrical connector assembly 100 is a Serial Advanced Technology Attachment (SATA) connector for transmitting signals and power. The electrical connector assembly 100 comprises a housing 1, a plurality of contacts 6 received in the housing 1, a plurality of cables 4 electrically connected to the contacts, a grounding portion 5 respectively connected to the cables 4 and contacts 6, a cover 2 assembled on the rear portion of the housing 1, and a board 3 assembled with the housing 1.

The housing 1 comprises a mating portion 11 on the front portion thereof, a pair of wing portions 12 respectively extending from two sides of the rear wall of the mating portion 11, a supporting portion 13 rearward extending from the rear wall and a bottom portion 18 communicating with two wing portions 12 and located under the supporting portion 13. The mating portion 11 is used to connect to a complementary connector along a mating direction and comprises a plurality of receiving slots 110 for receiving contacts 6. The receiving slots 110 pass through the mating portion 11 and are located between the two wing portions 12. A baffle 112 divides the receiving slots 110 into two parts.

The two wing portions 12 substantially have the same structure. Each wing portion 12 comprises a main body 121 extending from the rear wall of the mating portion 11 along a direction perpendicular to the mating direction, a secondary portion 122 rearward and outward extending from the main body 121. The secondary portion 122 is of L-shaped configuration and the main body 121 and the secondary portion 122 together define a Z-like configuration in a top view. Each main body 121 has a swallow-tailed slot 1210 located on the joint of the top surface and rear surface thereof, and the swallow-tailed slot 1210 has a wider front portion and a narrower rear portion. Each secondary portion 122 has a locking portion 1220 formed on the bottom thereof. The locking portion 1220 has a clasp portion 1221 bending ahead. The supporting portion 13 has a fastening portion 15 formed on the rear surface thereof, and a pair of receiving grooves 14 is located on the two sides of the fastening portion 15. The fastening portion 15 comprises an upper lip portion 151 and a lower lip portion 152, which two together form a U-shaped slot therebetween.

The housing 1 further comprises a plurality of protrusions 16 rearward extending from the rear wall thereof along a horizontal direction. The protrusions 16 are arranged in two rows and a receiving trough (not labeled) is formed between the two rows of the protrusions 16 for receiving the grounding portion 5. The receiving trough is located above the receiving slots 110. Every contact 6 comprises a tail 61 extending out the receiving slots 110 and bend up to be attached the rear wall and connected to its corresponding cable 4.

Every cable 4 comprises an inner conductor 44 connected to the tail 61 of the contact 6, an inner insulation layer 43 received in lower row of the protrusions 14, an outer conductor 42 connected to the grounding portion 5 and an outer insulation layer 41.

The cover 2 comprises a top wall and a rear wall downward extending from the top wall. There is no bottom wall in the cover. A projection 22 is formed in the middle of the top wall of the cover 2 and downward extends from the top wall of the cover 2 for attaching the rear portion of the top wall of the housing 10. A pair of swallow-tailed protrusions 21, which are corresponding to the swallow-tailed slots 1210 of the housing 10, are respectively located on the two sides of the projection 22 and frontward extends form the top wall of the cover 2. A fastening rib 24 is formed on the bottom of the rear wall of the cover 2 for mating to the lip portion 15 of the housing 10. A pair of protrudent pieces 23 is arranged on the two sides of the fastening rib 24. A hole 25 is formed on one side of the cover 2.

The board 3 is made from insulation material and can be a part of cover of a notebook computer. The board 3 comprises a main board 31 and a fastening board 32 upward extending from the main board 31 along a vertical direction. The fastening board 32 comprises a front wall 321 and a rear wall 322. A fastening groove 323 is formed between the front wall 321 and the rear wall 322. Both front wall 321 and the rear wall 322 have a gap (not labeled) in the middle thereof. Thus, the fastening groove 323 is substantially of U-shaped configuration and comprises a lengthwise horizontal groove 3232 and a pair of vertical groove 3231 located on two sides of the horizontal groove 3232 and connected to the horizontal groove 3232. A pair of locking slots 3210 is formed on the front wall 321 for corresponding to the locking portion 1220 of the housing 10. A blocking wall 324 upward extends from the rear surface of the rear wall 322 for attaching the rear wall of the cover 2.

In assembly, firstly the cover 2 is assembled on the housing 1 through the swallow-tailed slots 1210 mating to the swallow-tailed protrusions 21 and the fastening portion 15 connected to the fastening rib 24. Secondly, the bottom portion 18 of the housing 1 is inserted into the horizontal groove 3232 of the fastening groove 323 and the main bodies 121 of the wing portions 12 are received in the gap of the front wall 321 of the fastening board 32. The secondary portions 122 of the wing portions 12 are inserted into the vertical grooves 3231 of the fastening groove 323 with the locking portions 1220 inserted into the locking slots 3210.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a housing comprising a mating portion defining a mating direction and located on the front portion thereof and a supporting portion rearward extending from the mating portion;

a plurality of contacts receiving in the housing;

a cover assembled on the housing;

a plurality of cables electrically connected to the contacts; wherein the housing further comprises a pair of wing portions extending from an rear wall of the mating portion and defining substantially a Z-like configuration in a top view.

2. The electrical connector as claimed in claim 1, wherein supporting portion comprises a fastening portion formed on a rear surface thereof and the cover comprises a fastening rib corresponding to the fastening portion.

3. The electrical connector as claimed in claim 2, wherein the fastening portion comprises an upper lip portion and a lower lip portion, which the two portions together form a U-shaped slot therebetween.

4. The electrical connector as claimed in claim 3, wherein the supporting portion further comprises a pair of receiving grooves located on the two sides of the fastening portion, the cover comprises a pair of protrudent pieces arranged on two sides of the fastening rib for mating to the receiving grooves.

5. The electrical connector as claimed in claim 1, wherein each of the wing portion comprises a swallow-tailed slot and the cover comprises a pair of swallow-tailed protrusions corresponding to the swallow-tailed slots of the wing portions.

6. The electrical connector as claimed in claim 5, wherein the wing portion comprises a main body extending from the rear wall of the mating portion along a direction perpendicular to the mating direction, and a secondary portion rearward and outward extending from the main body, said swallow-tailed slots are respectively formed on the two main bodies of the wing portions.

7. An electrical connector assembly, comprising:

a housing comprising a mating portion defining a mating direction and located on the front portion thereof and a supporting portion rearward extending from the mating portion;

a plurality of contacts receiving in the housing;

a cover assembled on the housing;

a plurality of cables electrically connected to the contacts;

a board comprising a main board and a fastening board extending from the main board along a vertical direction, the fastening board comprising a fastening groove to fasten the housing; wherein the housing further comprises a pair of wing portions extending from an rear wall of the mating portion and defining a pair of locking portion and the fastening board comprises a pair of locking slots corresponding to the locking portion, the locking portion is received in the fastening groove and extends into the locking slots.

8. The electrical connector assembly as claimed in claim 7, wherein supporting portion comprises a fastening portion formed on a rear surface thereof and the cover comprises a fastening rib corresponding to the fastening portion.

9. The electrical connector assembly as claimed in claim 8, wherein the fastening portion comprises an upper lip portion and a lower lip portion, which two together form a U-shaped slot therebetween.

10. The electrical connector assembly as claimed in claim 9, wherein the supporting portion further comprises a pair of receiving grooves located on the two sides of the fastening portion, the cover comprises a pair of protrudent pieces arranged on two sides of the fastening rib for mating to the receiving grooves.

11. The electrical connector assembly as claimed in claim 7, wherein each of the wing portion defines a Z-like configuration in a top view and comprises a swallow-tailed slot and the cover comprises a pair of swallow-tailed protrusions corresponding to the swallow-tailed slots of the wing portions.

12. The electrical connector assembly as claimed in claim 11, wherein the wing portion comprises a main body extending from the rear wall of the mating portion along a direction perpendicular to the mating direction, and a secondary portion rearward and outward extending from the main body, said swallow-tailed slots are respectively formed on the two main bodies of the wing portions.

13. The electrical connector assembly as claimed in claim 7, wherein the fastening board comprises a front wall and a rear wall, both of which have a gap in the middle thereof.

14. The electrical connector assembly as claimed in claim 13, wherein the fastening board further comprises a fastening groove formed between the front wall and the rear wall and being substantially of U-shaped configuration.

15. The electrical connector assembly as claimed in claim 14, wherein the fastening groove comprises a lengthwise horizontal groove and a pair of vertical grooves located on two sides of the horizontal groove and connected to the horizontal groove.

16. The electrical connector assembly as claimed in claim 15, wherein the locking slots are formed on the front wall of the fastening groove, and a blocking wall upward extends from a rear surface of the rear wall for attaching the rear wall of the cover.

17. An electrical connector assembly comprising:

a fastening board defining opposite front and rear walls commonly sandwiching a fastening groove structure therebetween in a front-to-back direction, said front wall defining a forward opening;

an insulative housing defining a forwardly extending mating portion and a pair of wing portions at two opposite ends in a lengthwise direction perpendicular to said front-to-back direction wherein a dimension of the mating portion in said lengthwise direction is smaller than that of the opening;

a plurality of contacts disposed in the housing having front contacting sections exposed in the mating portion and rear connecting sections; and a cable including a plurality of wires mechanically and electrically connected to the rear connecting sections of the corresponding contacts, respectively; wherein the pair of wing portions are respectively into the corresponding fastening groove structure by two sides of the opening in said lengthwise direction, and interlocking devices are formed on the wing portions and the fastening board under condition that said pair of wing portions are inserted into the fastening groove structure in a first vertical direction perpendicular to both said front-to-back direction and said lengthwise direction while said interlocking device prevents withdrawal of said wing portions in a second vertical direction opposite to said first vertical direction.

18. The electrical connector assembly as claimed in claim 17, wherein said fastening groove structure defines essentially a U-shaped configuration, and the housing further defines a bottom portion so that the bottom portion cooperates with the pair of wing portions are commonly inserted into and received in the fastening groove structure for reinforcing retention between the housing and the fastening groove.

19. The electrical connector assembly as claimed in claim 17, wherein said housing is equipped with a cover fastened upon a rear face of the housing and cooperating with the housing to sandwich said cable therebetween in said front-to-back direction.

20. The electrical connector assembly as claimed in claim 17, wherein the housing defines an offset structure between the pair of wing portion s and the mating portion in said front-to-back direction.

* * * * *